US007295093B2

(12) United States Patent
Umezaki et al.

(10) Patent No.: US 7,295,093 B2
(45) Date of Patent: Nov. 13, 2007

(54) INTERNAL COMBUSTION ENGINE IGNITION COIL APPARATUS

(75) Inventors: Tomokazu Umezaki, Tokyo (JP); Nobuyuki Sawazaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 46 days.

(21) Appl. No.: 11/246,068

(22) Filed: Oct. 11, 2005

(65) Prior Publication Data

US 2007/0006859 A1 Jan. 11, 2007

(30) Foreign Application Priority Data

Jun. 24, 2005 (JP) ..... 2005-184789

(51) Int. Cl.
*H01F 27/29* (2006.01)

(52) U.S. Cl. ..... 336/192

(58) Field of Classification Search ..... 336/65, 336/90–96, 107, 192; 123/634–635
See application file for complete search history.

(56) References Cited

U.S. PATENT DOCUMENTS 4,528,971 A * 7/1985 Huttinger et al. ..... 123/634
5,419,300 A * 5/1995 Maruyama et al. ..... 123/634
5,461,316 A * 10/1995 Maruyama et al. ..... 324/402
5,487,676 A * 1/1996 Maruyama et al. ..... 439/125
7,132,916 B2 * 11/2006 Maekawa et al. ..... 336/90

FOREIGN PATENT DOCUMENTS

| | | | |
|---|---|---|---|
| DE | 1 938 688 U | | 5/1966 |
| DE | 103 53 002 A1 | | 5/2005 |
| JP | 54-44163 Y2 | | 12/1979 |
| JP | 03-267581 | * | 11/1991 |
| JP | 11-040444 | * | 2/1999 |

* cited by examiner

*Primary Examiner*—Tuyen T. Nguyen
(74) *Attorney, Agent, or Firm*—Sughrue Mion, PLLC

(57) ABSTRACT

An internal combustion engine ignition coil apparatus includes: a case; a center core disposed in the case; a primary coil and a secondary coil disposed outside the center core inside the case; a high-voltage cord having: a first end portion electrically connected to the secondary coil; and a second end portion electrically connected to a spark plug; and a protective tube covering an outer peripheral surface of the high-voltage cord, a rim portion projecting away from a high-voltage terminal being formed so as to surround an insertion aperture in a bottom portion of the case, and a leading end portion of the protective tube covering and elastically engaging with the rim portion, wherein: a receiving portion having a radially-outwardly-projecting V-shaped cross-sectional shape when sectioned axially is formed on an end portion of the rim portion.

3 Claims, 3 Drawing Sheets

INTERNAL COMBUSTION ENGINE IGNITION COIL APPARATUS

BACKGROUND OF THE INVENTION

1. Field of the Invention

The present invention relates to an internal combustion engine ignition coil apparatus in which a high-voltage cord having a first end portion electrically connected to a secondary coil by means of a high voltage terminal and a second end portion electrically connected to a spark plug is covered by a protective tube, and a leading end portion of the protective tube is engaged elastically with a rim portion for leading out the high-voltage cord.

2. Description of the Related Art

Conventionally, internal combustion engine ignition coil apparatuses are known in which a groove portion formed so as to extend circumferentially is formed on an annular rim portion for leading out a high-voltage cord connected to a secondary coil by means of a high-voltage terminal, and a leading end portion of a protective tube covering an outer peripheral surface of the high-voltage cord engages with the groove portion by elastic force to prevent water from penetrating inside through the rim portion. (See Patent Literature 1, for example.)

Patent Literature 1

Japanese Utility Model Publication No. SHO 54-44163 (Gazette)

In conventional internal combustion engine ignition coil apparatuses, because an inside diameter dimension at the leading end portion of the protective tube is less than an outside diameter dimension at an end surface of the rim portion, as the leading end portion of the protective tube is inserted into the rim portion, at first a leading end surface of the protective tube is inserted in a radially-outwardly expanded state, then the outside diameter dimension of the rim portion decreases suddenly over the groove portion partway through insertion, the outside diameter dimension of the leading end surface of the protective tube also contracts suddenly in response, and the leading end portion of the protective tube engages elastically in the groove portion.

In such internal combustion engine ignition coil apparatuses, engaging force of the protective tube against the rim portion is mainly due to contractive force of the leading end portion of the protective tube, but at the rim portion the protective tube may be repeatedly subjected to thermal stresses due to heat generated by the coil of the ignition coil apparatus itself, heat originating from the internal combustion engine, external air heat, etc., and may also be subjected repeatedly to stresses due to vibration.

Consequently, one problem has been that when the leading end portion of the protective tube is inserted into the rim portion, in the case of a protective tube exhibiting sudden changes due to stress, reductions in the contractive force (the engaging force) and progression of stiffening of the protective tube due to repeated thermal stresses and stresses due to vibration are each accelerated, and in some cases there is a risk that water proofing properties of the protective tube may not be ensured since the protective tube may crack, and the protective tube may move axially and disengage from the rim portion due to the reductions in the engaging force.

SUMMARY OF THE INVENTION

The present invention aims to solve the above problems and an object of the present invention is to provide an internal combustion engine ignition coil apparatus in which reductions in engaging force and progression of stiffening of a protective tube are suppressed so as to improve water proofing by the protective tube.

In order to achieve the above object, according to one aspect of the present invention, there is provided an internal combustion engine ignition coil apparatus including: a cup-shaped case; a center core disposed in the case; a primary coil and a secondary coil disposed outside the center core inside the case; a high-voltage cord having: a first end portion electrically connected to the secondary coil by means of a high voltage terminal; and a second end portion electrically connected to a spark plug; and a protective tube covering an outer peripheral surface of the high-voltage cord, an insertion aperture into which the high-voltage cord is inserted being formed in a bottom portion of the case, a rim portion projecting externally being formed so as to surround the insertion aperture, and a leading end portion of the protective tube covering and elastically engaging with the rim portion, wherein: a receiving portion having a radially-outwardly-projecting V-shaped cross-sectional shape when sectioned axially is formed on an end portion of the rim portion.

Using an internal combustion engine ignition coil apparatus having the above configuration, reductions in engaging force and progression of stiffening of a protective tube are suppressed so as to improve water proofing by the protective tube.

DETAILED DESCRIPTION OF THE PREFERRED EMBODIMENT

Embodiment 1

Figure 1:
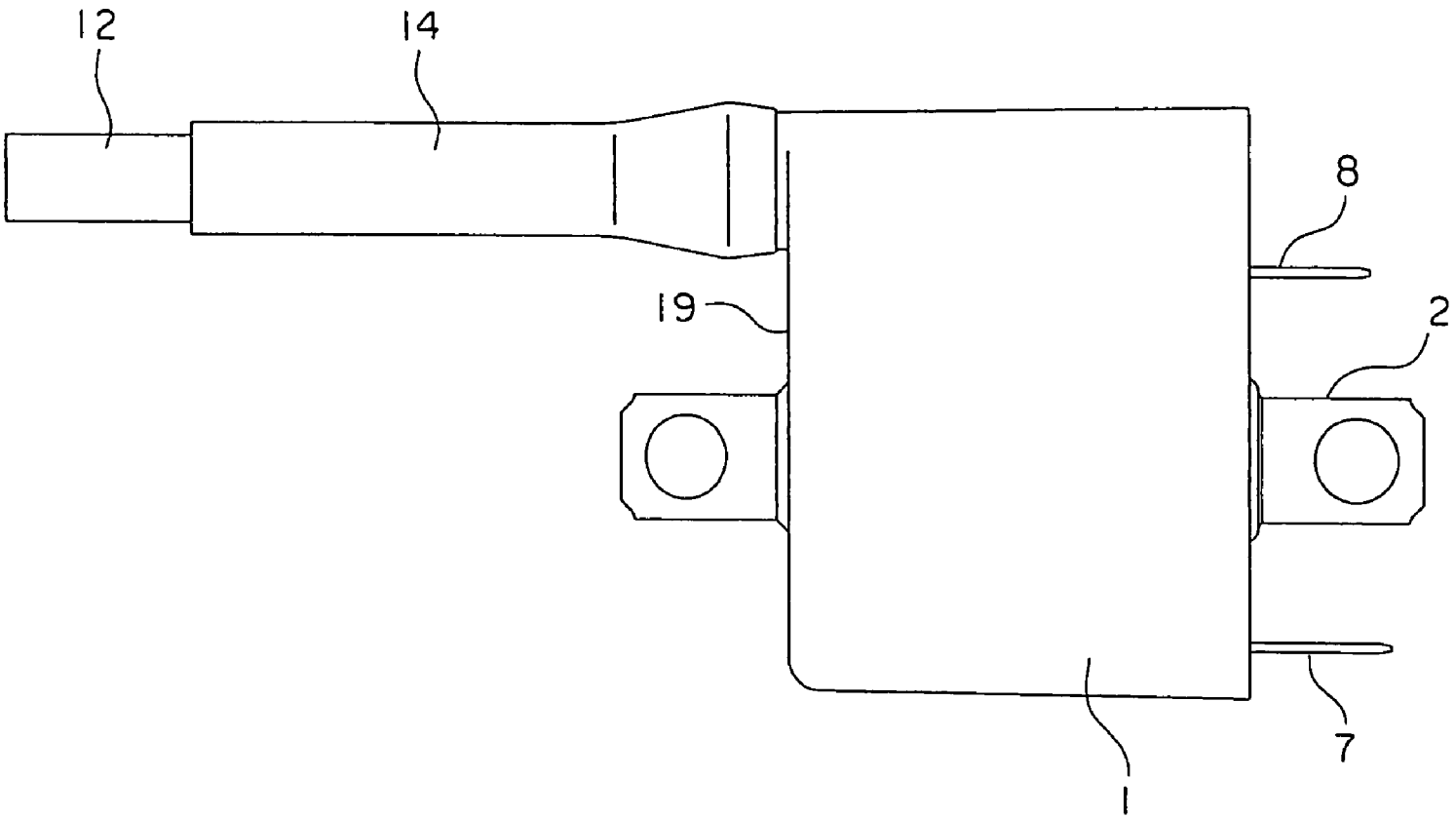
FIG. 1 is a front elevation showing an internal combustion engine ignition coil apparatus according to Embodiment 1 of the present invention.
Figure 2:
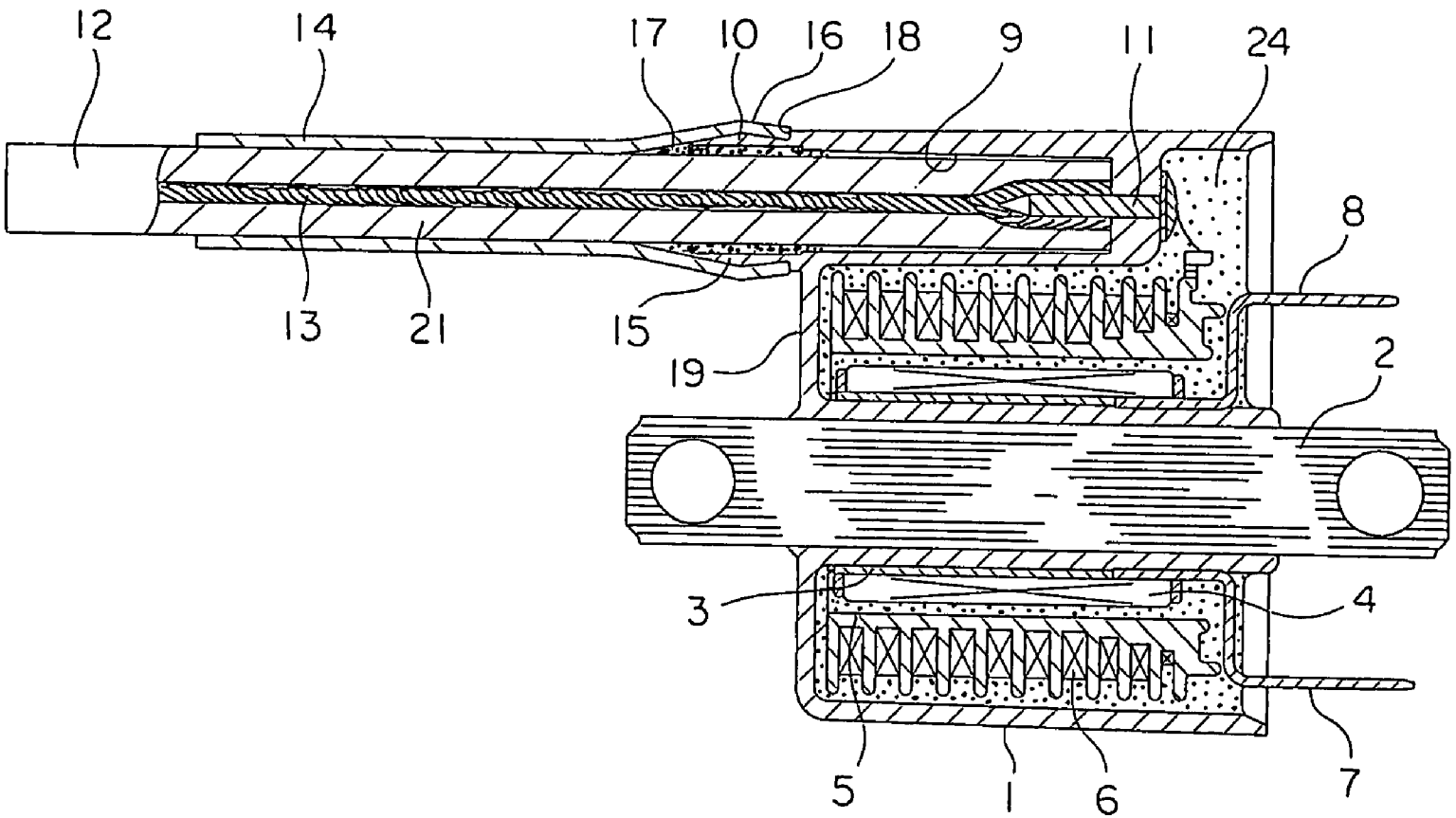
FIG. 2 is a regular cross section of FIG. 1.
Figure 3:
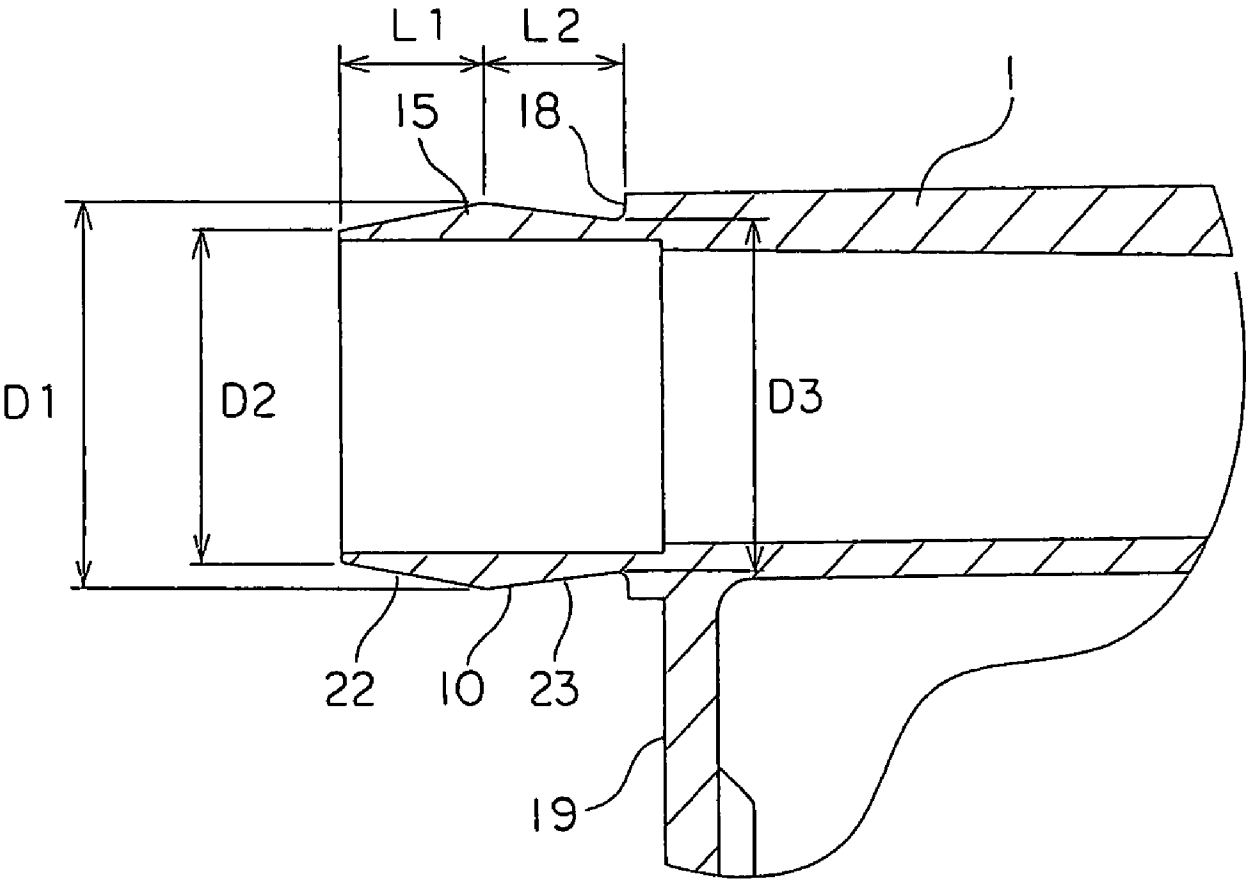
FIG. 3 is an enlargement showing part of a case from FIG. 1.

FIG. 1 is a front elevation showing an internal combustion engine ignition coil apparatus according to Embodiment 1 of the present invention; FIG. 2 is a regular cross section of FIG. 1; and FIG. 3 is an enlargement showing part of a case from FIG. 1.

In this internal combustion engine ignition coil apparatus, a center core 2 configured by stacking electromagnetic steel plates and fixed to a vehicle body frame (not shown) is disposed in a cup-shaped case 1 so as to pass through a bottom portion 19.

A primary coil 4 configured by winding a conducting wire onto a primary bobbin 3 is disposed outside the center core 2. A secondary coil 6 configured by winding a conducting wire onto a secondary bobbin 5 is disposed outside the primary coil 4.

A winding start end portion of the conducting wire of the primary coil 4 is electrically connected to a negative terminal 7. A winding finish end portion of the conducting wire of the primary coil 4 is electrically connected to a positive terminal 8. A winding start end portion of the conducting wire of the secondary coil 6 is electrically connected to the positive terminal 8. The winding finish end portion of the conducting wire of the secondary coil 6 is electrically connected to a nail-shaped high-voltage terminal 11.

An insertion aperture 9 is formed in the bottom portion 19 of the case 1, and an annular rim portion 10 projecting away from the high-voltage terminal 11 is formed so as to surround the insertion aperture 9. A first end portion of a high-voltage cord 12 is inserted into the insertion aperture 9 such that a leading end portion of the high-voltage cord 12 is electrically connected to the high-voltage terminal 11.

The high-voltage cord 12, which has a second end portion that can be electrically connected to a spark plug (not shown), is constituted by: a conducting core wire 13 constituted by a stranded wire; and an insulating rubber 21 covering the conducting core wire 13.

An end portion of the high-voltage cord 12 near the rim portion 10 is covered by a protective tube 14 made of an elastomer. A leading end portion of the protective tube 14 covers and engages with the rim portion 10 elastically.

As shown in FIG. 3, a receiving portion 15 having a radially-outwardly-projecting V-shaped cross-sectional shape when sectioned axially is formed on an end portion of the rim portion 10.

The receiving portion 15 has: a first tapered surface 22 that gradually widens radially toward the high-voltage terminals 11; and a second tapered surface 23 that gradually reduces radially. A stepped portion 18 is formed on an end portion of the second tapered surface 23 near the high-voltage terminals 11.

An internal combustion engine ignition coil apparatus having the above configuration can be manufactured by the following procedure.

The case 1 is integrated with the center core 2 passing through the bottom portion 19 by insertion molding in advance, the primary coil 4 and the secondary coil 6 are placed inside the case 1 through an opening portion on one side of the case 1, and the negative terminal 7 and the positive terminal 8 are each placed so as to project externally through the opening portion. The high-voltage terminal 11 is passed through and fixed to the case 1.

Next, the winding start end portion of the conducting wire of the primary coil 4 is connected electrically to the negative terminal 7, the winding finish end portion of the conducting wire of the primary coil 4 is connected electrically to the positive terminal 8, the winding start end portion of the conducting wire of the secondary coil 6 is connected electrically to the positive terminal 8, and the winding finish end portion of the conducting wire of the secondary coil 6 is connected electrically to the nail-shaped high-voltage terminal 11.

After that, the case 1 is filled with a thermosetting resin 24 in a vacuum, the resin is made to impregnate between the conducting wires of the primary coil 4 and the secondary coil 6, and then the thermosetting resin 24 is hardened by heating.

Finally, the leading end portion of the high-voltage cord 12 is inserted through the insertion aperture 9 of the case 1 until the leading end surface of the protective tube 14 comes into contact with the stepped portion 18 and the conducting core wire 13 is pressed into the leading end portion of the high-voltage terminal 11 so as to connect the high-voltage cord 12 and the high-voltage terminal 11 electrically.

Moreover, an adhesive 17 made of an epoxy resin is applied in advance to an outer peripheral surface of the high-voltage cord 12 from the protective tube 14 toward the high-voltage terminal 11, and as the leading end portion of the high-voltage cord 12 is inserted through the insertion aperture 9 of the case 1, the adhesive 17 is pushed toward the rim portion 10 together with the insertion of the high-voltage cord 12, and adhesive 17 thus pushed out hardens at an entrance portion of the rim portion 10.

As the leading end portion of the high-voltage cord 12 is being inserted into the insertion aperture 9 of the case 1, at the receiving portion 15, the leading end surface of the protective tube 14 advances along the first tapered surface 22 while gradually spreading radially, then advances along the second tapered surface 23 while gradually contracting radially when the line of intersection between the first tapered surface 22 and the second tapered surface 23 is exceeded, and engagement of the protective tube 14 against the receiving portion 15 is completed when the leading end surface comes into contact with the stepped portion 18.

Moreover, the larger an outside diameter dimension D1 of the above line of intersection relative to an inside diameter dimension D of the protective tube 14, the more difficult the operation of inserting the receiving portion 15 of the rim portion 10 into the protective tube 14, but the greater the engaging force of the protective tube 14 against the receiving portion 15. Conversely, the smaller the outside diameter dimension D1 of the above line of intersection, the easier the operation of inserting the receiving portion 15 of the rim portion 10 into the protective tube 14, but the smaller the engaging force of the protective tube 14 against the receiving portion 15.

The value of the engaging force may vary depending on the degree of elasticity of the protective tube 14, but an appropriate value for the outside diameter dimension D1 can be determined if the material, thickness, hardness, etc., of the protective tube 14 are fixed.

Increasing an axial length L1 of the first tapered surface 22 and an axial length L2 of the second tapered surface 23 increases the engaging force of the protective tube 14 against the receiving portion 15, but leads to increases in the size of the case 1. Conversely, although reducing the axial length L1 of the first tapered surface 22 and the axial length L2 of the second tapered surface 23 decreases the engaging force of the protective tube 14 against the receiving portion 15, one advantage is that the size of the case 1 can be reduced.

The axial length L1 of the first tapered surface 22 and the axial length L2 of the second tapered surface 23 can be set according to the required engaging force, the available space in the region of installation, etc.

Moreover, the present inventors have ascertained empirically that if the inside diameter dimension of the protective tube 14 is D (mm), then relative to a maximum outside diameter dimension D1 (mm) of the receiving portion 15, a minimum outside diameter dimension D2 (mm) of the first tapered surface 22, and a minimum outside diameter dimension D3 (mm) of the second tapered surface 23, respectively, it is desirable to have the following relationships:

$$D1=D+\alpha1, \text{ where } \alpha1=2.0 \text{ to } 3.0 \text{ (mm)};$$

$$D2=D+\alpha2, \text{ where } \alpha2=0.0 \text{ to } 1.5 \text{ (mm); and}$$

$$D3=D+\alpha3, \text{ where } \alpha3=0.5 \text{ to } 1.5 \text{ (mm)}.$$

The present inventors have also ascertained empirically that values from 3.5 to 5.0 mm are desirable for the axial length L1 (mm) of the first tapered surface 22 and the axial length L2 (mm) of the second tapered surface 23.

In an internal combustion engine ignition coil apparatus having the above configuration, when a primary current flowing through the primary coil 4 is interrupted by a control signal from a control unit (not shown) of an internal combustion engine at a predetermined ignition timing for the internal combustion engine, a reverse electromotive force arises in the primary coil 4, generating a high voltage in the secondary coil 6.

The generated high voltage is applied to a spark plug of the internal combustion engine connected through the high-voltage cord 12.

In an internal combustion engine ignition coil apparatus having the above configuration, because a receiving portion 15 having a radially-outwardly-projecting V-shaped cross-sectional shape when sectioned axially is formed on an end portion of the rim portion 10, the protective tube 14 is raised onto and engaged with the rim portion 10 comparatively easily, improving workability when mounting the protective tube 14 onto the rim portion 10.

Because the leading end surface of the protective tube 14 advances along the first tapered surface 22 and the second tapered surface 23 at the receiving portion 15 as the leading end portion of the protective tube 14 is mounted onto the rim portion 10, there are no sudden changes in the leading end portion of the protective tube 14 due to stress. For this reason, reductions in engaging force and progression of stiffening of the protective tube resulting from sudden changes due to stress that occurred in conventional configurations are each suppressed, reducing the occurrence of cracking of the protective tube 14 and improving water proofing.

Even if force acts in a direction that would dislodge the protective tube 14 from the rim portion 10 if the protective tube 14 has lost elasticity and become stiff due to environmental temperature stress, the second tapered surface 23 acts as a surface to resist that force, and the protective tube 14 will not dislodge from the rim portion 10 easily.

Because a stepped portion 18 contacted by the leading end surface of the protective tube 14 is formed on the receiving portion 15 near the high-voltage terminal 11, the conducting core wire 13 can be reliably electrically connected to the high-voltage terminal 11 by ceasing the operation of inserting the high-voltage cord 12 into the insertion aperture 9 when the leading end surface of the protective tube 14 comes into contact with the stepped portion 18 of the receiving portion 15 during the operation of mounting the protective tube 14 onto the rim portion 10. Furthermore, an inside diameter surface at the leading end portion of the protective tube 14 will not separate from surfaces of the receiving portion 15, and the inside diameter surface of the leading end portion is placed reliably in surface contact with the first tapered surface 22 and the second tapered surface 23, firmly engaging the leading end portion of the protective tube 14 with the rim portion 10.

Because the adhesive 17 is interposed between the inside diameter surface of the rim portion 10 and the outer peripheral surface of the high-voltage cord 12, water proofing is ensured even if the protective tube 14 were somehow to dislodge from the rim portion 10.

What is claimed is:

1. An internal combustion engine ignition coil apparatus comprising:

a cup-shaped case;

a center core disposed in said case;

a primary coil and a secondary coil disposed outside said center core inside said case;

a high-voltage cord having:

a first end portion electrically connected to said secondary coil by means of a high voltage terminal; and a second end portion electrically connected to a spark plug; and a protective tube covering an outer peripheral surface of said high-voltage cord, an insertion aperture into which said high-voltage cord is inserted being formed in a bottom portion of said case, a rim portion projecting externally being formed so as to surround said insertion aperture, and a leading end portion of said protective tube covering and elastically engaging with said rim portion, wherein:

a receiving portion having a radially-outwardly-projecting V-shaped cross-sectional shape when sectioned axially is formed on an end portion of said rim portion.

2. The internal combustion engine ignition coil apparatus according to claim 1, wherein:

a stepped portion contacted by a leading end surface of said protective tube is formed on said receiving portion near said high-voltage terminal.

3. The internal combustion engine ignition coil apparatus according to claim 1, wherein:

an adhesive is interposed between an inside diameter surface of said rim portion and an outer peripheral surface of said high-voltage cord.

* * * * *